US010967234B2

(12) United States Patent
Nelson

(10) Patent No.: US 10,967,234 B2
(45) Date of Patent: Apr. 6, 2021

(54) PUTTER SHAFT WITH DECORATIVE SLEEVES

(71) Applicant: Eric Nelson, Sammamish, WA (US)

(72) Inventor: Eric Nelson, Sammamish, WA (US)

( * ) Notice: Subject to any disclaimer, the term of this patent is extended or adjusted under 35 U.S.C. 154(b) by 0 days.

(21) Appl. No.: 16/511,684

(22) Filed: Jul. 15, 2019

(65) Prior Publication Data

US 2021/0016143 A1 Jan. 21, 2021

(51) Int. Cl.
*A63B 53/10* (2015.01)
*A63B 53/00* (2015.01)

(52) U.S. Cl.
CPC ..... *A63B 53/10* (2013.01); *A63B 53/007* (2013.01); *A63B 2209/02* (2013.01)

(58) Field of Classification Search
CPC .... A63B 53/10; A63B 53/007; A63B 2209/02
USPC ..... 473/316
See application file for complete search history.

(56) References Cited

U.S. PATENT DOCUMENTS

2009/0069111 A1* 3/2009 Takeuchi ..... A63B 60/00 473/316
2009/0270197 A1* 10/2009 Holtzman ..... A63B 60/00 473/296
2009/0305810 A1* 12/2009 Kim ..... A63B 53/10 473/319
2011/0081983 A1* 4/2011 Johnson ..... C23C 14/0641 473/288
2015/0202505 A1* 7/2015 Halpin ..... A61H 23/0263 473/220

* cited by examiner

*Primary Examiner* — William M Pierce
(74) *Attorney, Agent, or Firm* — Seattle Patent Group LLC; James Haugen

(57) ABSTRACT

A shaft for a putter includes decorative sheaths that may beautify the shaft while retaining lightweight stiffness and avoiding breaking the sheaths.

22 Claims, 2 Drawing Sheets

PUTTER SHAFT WITH DECORATIVE SLEEVES

FIELD

The disclosure relates to a shaft for a putter.

SUMMARY

Golf clubs are luxury articles that are used by both professional sportsmen and amateur hobbyists. While a variety of functional clubs are available that cater to the preferences of professional and serious amateur golfers, there are relatively few golf club shafts and especially putter shafts that appeal to golfers because of their beauty. The present putter shaft preserves the utilitarian qualities desired by golfers (e.g., a lightweight, stiff putter shaft), but provides a system whereby the putter may be made beautiful, as well.

In one aspect, a shaft for a golf putter may include a central core having a distal end and a proximal end, a plurality of decorative sheaths configured to be threaded onto the central core, a handle connector, and a hosel connector. The connectors may be arranged so that a load on the putter upon striking a ball is primarily applied to the shaft core and not to the decorative sheaths, and may also retain the sheaths in a fixed position between them on the central core. The central core may include carbon fiber, steel, titanium, brass, copper, zinc, or alloys of any of these. The decorative sheaths may include hardwood, softwood, plastic, such as epoxy, optionally including embedded materials, or carbon fiber, and they may fit flush against the central core.

In another aspect, a golf putter may include a shaft core having a distal end and a proximal end, a plurality of decorative sheaths threaded onto the shaft core, a handle connected to the proximal end of the shaft by a handle connector, a grip connected to the handle, a hosel connected to the distal end of the shaft by a hosel connector, and a head connected to the hosel. The handle connector and hosel connector may be arranged so that a load on the putter upon striking the ball is primarily applied to the shaft core, rather than the decorative sheaths, and may also be arranged to retain the plurality of decorative sheaths in place between them. The handle connector may be permanently affixed to the shaft core and the handle, and the hosel connector may be permanently affixed to the shaft core and the hosel.

In another aspect, a method of making a putter shaft may include threading decorative sheaths over a shaft core, attaching a handle to a proximal end of the shaft core, and attaching a hosel to the distal end of the shaft core, wherein a load on the putter shaft upon striking a ball with the putter is primarily applied to the shaft core and not to the decorative sheaths. Hosel and handle may be attached, for example, by glue, and the hosel may be integral with or attached to a putter head.

In another aspect, a kit for assembling a putter shaft may include a shaft core having a proximal end and a distal end, a plurality of blanks configured to be threaded onto the shaft core, and instructions for assembling the preceding elements. The blanks may be configured to be formed on a lathe to create sheaths for threading onto the shaft core. The proximal end of the shaft may include a handle connector configured to join the proximal end to a handle, and the distal end may include a hosel connector configured to join the distal end to a hosel. These connectors may be arranged to transfer load from striking a golf ball substantially to the shaft, rather than to the blanks or the decorative sheaths. The kit may further include a handle, a grip, or a hosel, which may be integral with the putter head.

DETAILED DESCRIPTION

Figure 1:
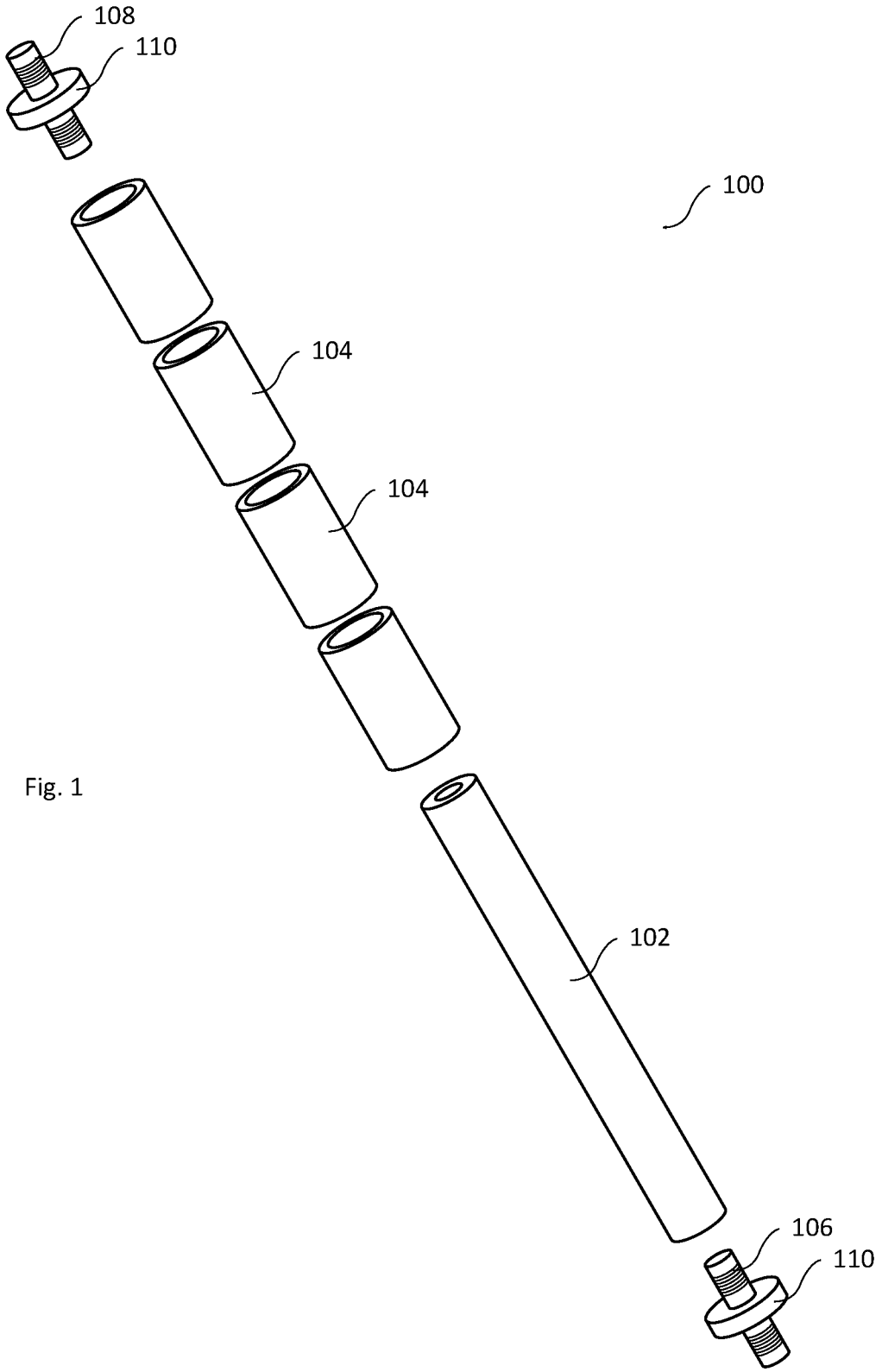
FIG. 1 is an exploded view of parts of a putter shaft.

A more particular description of certain embodiments of Putter Shaft may be had by reference to the embodiments described below, and those shown in the drawings that form a part of this specification, in which like numerals represent like objects. It is understood that the description and drawings represent example implementations and are not to be understood as limiting. Drawings are not drawn to scale unless otherwise noted herein.

FIG. 1 is an exploded view of parts of a decorative putter shaft 100. The figure includes a shaft core 102, which may be made of a stiff, light, resilient material such as a carbon fiber composite, aluminum, or steel. Decorative sheath(s) 104 may be sized to slide over the shaft core sections to cover them and provide a shaft having a decorative effect. For example, a sheath 104 may be manufactured on a lathe from a softwood or a hardwood or may be formed from acrylic or other plastics. In some implementations, plastic sheaths may have decorative elements embedded in them. Because the sheaths are not directly connected to adjacent sheaths (or to the handle and/or hose) of the shaft) but merely butt up against them, they do not tend to carry much load during a putt. FIG. 1 shows multiple sheaths 104, but in other implementations a single sheath, such as one that runs the length of shaft core 102, may be used. Sheath(s) 104 can thus be made of woods or other materials that would be unsuitable for a structural element such as a putter shaft. For example, sheaths have been made from box elder, Bethlehem olive wood, redwood burl, acrylic with embedded coffee beans, and carbon fiber twill. The inventor has found that "pen-blanks," commonly used for making custom pens, are conveniently sized and shaped to be turned on a lathe to create the decorative sheaths, but, of course, other woods or other materials may also be used for this purpose.

FIG. 1 further shows a hosel connector 106 and a handle connector 108, which are arranged to be affixed to shaft 102 at its proximal and distal ends, respectively. Each of these connectors may include a retaining ring 110, which acts to retain sheaths 104 in place on core 102. Retaining rings 110 are optional and may be omitted from some implementations of the putter. According to the rules of the United States Golf Association (USGA), connectors 106, 108 must be "firmly fixed" so that no adjustment to them (or any other part of the putter) can be "readily made" during a round. Of course, outside of sanctioned play, players may use clubs with various adjustable features as permitted by their course, and either adjustable or fixed putters are within the scope of the present disclosure.

Figure 2:
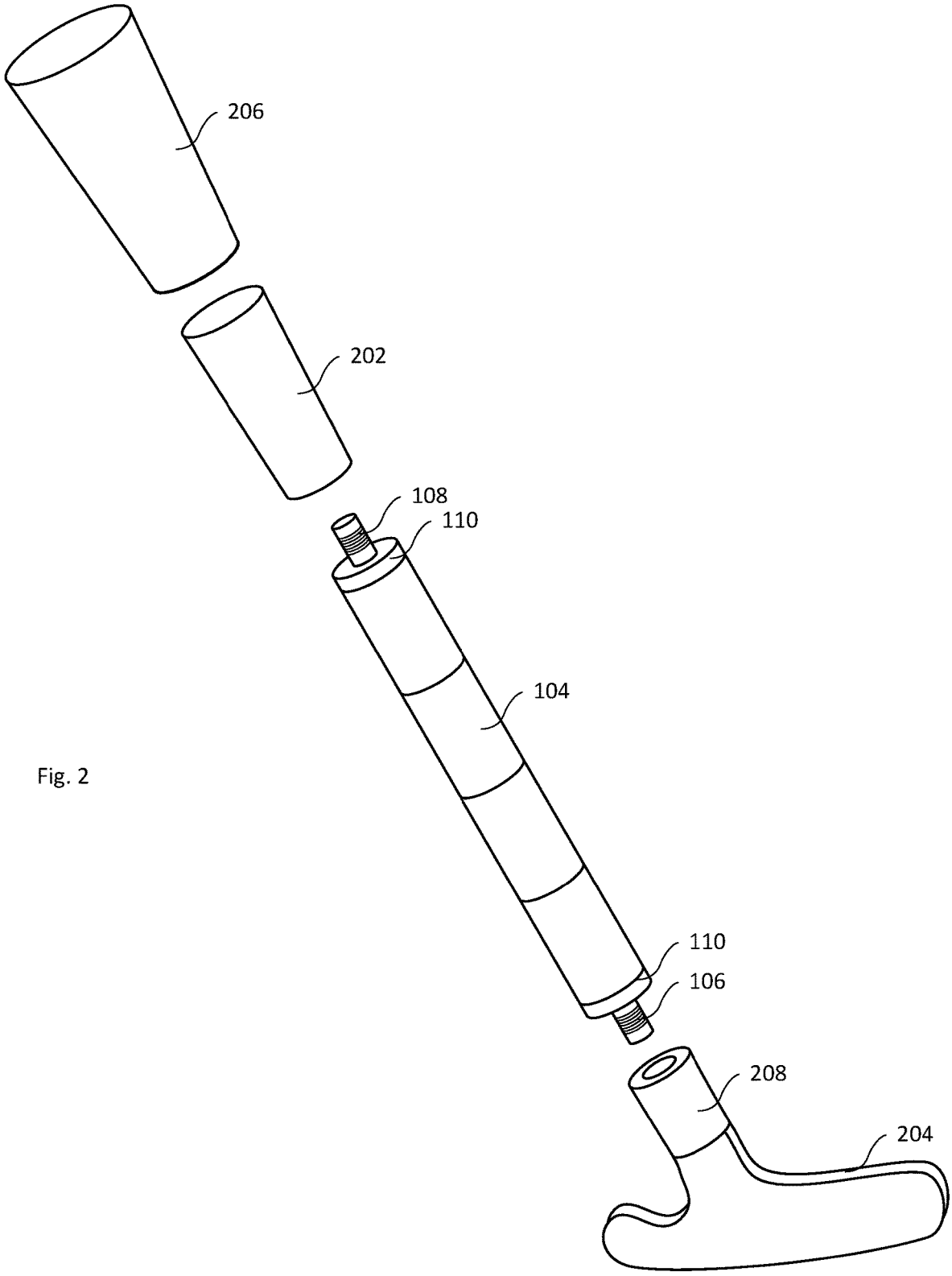
FIG. 2 is a fully assembled view of the parts shown in FIG. 1, and further includes other parts of a full putter.

FIG. 2 illustrates an assembled shaft to which handle 202 and head 204 may be attached to handle connector 108 and hosel connector 106, respectively. (The shaft as illustrated is unusually short so that detail of its ends may be more readily seen. Implementations for use by real golfers are intended to be longer and thinner than the shaft shown in FIG. 2) Retaining rings 110 may be seen to butt up against decorative sheaths 104 to hold them in place. In other implementations (not shown), the sheaths closest to handle 202 and head 204 may include a recess so that retaining rings 110 are not visible. It will be seen that sheaths 104 butt up against one another but are not directly connected. This arrangement means that the sheaths will not tend to transfer tensile or shear stresses to one another, thus protecting them from breakage when the putter is used in play.

The illustrated handle 202 is designed to be further mounted in grip 206, which may have appropriate features for comfort and reliability as chosen by an individual golfer. Head 204 is attached via hosel 208 to hosel connector 106. While it is possible that connectors 106, 108 may be threaded to connect to handle 202 and hosel 208, if it is desired to follow the USGA rule described above, they may be fixed in place, for example by epoxy or other adhesive.

While various aspects and embodiments have been disclosed herein, other aspects and embodiments will be apparent to those skilled in the art. The various aspects and embodiments disclosed herein are for purposes of illustration and are not intended to be limiting, with the true scope and spirit of the invention being indicated by the following claims.

The invention claimed is:

1. A shaft for a golf putter, comprising:

a shaft core having a distal end and a proximal end;

a plurality of decorative sheaths covering the shaft core, each decorative sheath is sized to slide over and around the shaft core;

a handle connector affixed to the proximal end of the shaft core;

a hosel connector affixed to the distal end of the shaft core, wherein the handle connector and the hosel connector having retaining rings that retain the decorative sheaths between the handle connector and the hosel connector such that the decorative sheaths butt up against each other and are not directly connected to adjacent decorative sheaths when the decorative sheaths are slid over and around the shaft core;

a handle affixed to the handle connector; and a hosel affixed to the hosel connector.

2. The shaft of claim 1, further comprising a putter head attached to the hosel.

3. The shaft of claim 1, further comprising a grip mounted onto the handle.

4. The shaft of claim 1, wherein the decorative sheaths include a material selected from the group consisting of epoxy, plastic, carbon fiber, hardwood, and softwood, and, wherein the shaft core includes a material selected from the group consisting of carbon fiber, steel, titanium, brass, copper, zinc, and alloys of one or more of the previous materials.

5. The shaft of claim 4, wherein the epoxy includes an embedded material.

6. The shaft of claim 1, wherein the decorative sheaths fit flush against the core.

7. A golf putter, comprising:

a shaft core having a distal end and a proximal end;

a plurality of decorative sheaths covering the shaft core, each of the decorative sheaths are threaded onto and around the shaft core;

a handle connector affixed to the proximal end of the shaft core;

a hosel connector affixed to the distal end of the shaft core, wherein the handle connector and the hosel connector having retaining rings that retain the decorative sheaths between the handle connector and the hosel connector such that the decorative sheaths butt up against each other and are not directly connected to adjacent decorative sheaths when the decorative sheaths are threaded around the shaft core;

a handle affixed to the handle connector;

a hosel affixed to the hosel connector; and a putter head connected to the hosel.

8. The putter of claim 7, further comprising a grip attached to the handle.

9. The putter of claim 7, wherein the handle connector is permanently affixed to the shaft core and to the handle.

10. The putter of claim 7, wherein the hosel connector is permanently affixed to the shaft core and to the hosel.

11. A method of making a putter shaft, the method comprising:

turning a plurality of blanks on a lather to create a plurality of decorative sheaths;

sliding the plurality of decorative sheaths over and around a shaft core;

affixing a handle connector to the proximal end of the shaft core;

affixing a hosel connector onto a distal end of the shaft core, wherein the handle connector and the hosel connector having retaining rings that retain the decorative sheaths between the handle connector and the hosel connector such that the decorative sheaths butt up against each other and are not directly connected to adjacent decorative sheaths when the decorative sheaths are slid over and around the shaft core;

attaching a handle onto the handle connector; and attaching a hosel onto the hosel connector.

12. The method of claim 11, wherein attaching the hosel to the hosel connector at the distal end of the shaft core includes gluing.

13. The method of claim 11, wherein attaching the handle to the handle connector at the proximal end of the shaft core includes gluing.

14. The method of claim 11, further comprising mounting a grip onto the handle.

15. The method of claim 11, further comprising attaching the hosel to a putter head.

16. A kit for assembling a putter shaft, comprising:

a shaft core having a proximal end and a distal end;

a plurality of decorative sheaths wherein each decorative sheath is sized to slide over and around the shaft core;

a handle connector;

a hosel connector, wherein the handle connector and the hosel connector having retaining rings that are sized to retain the decorative sheaths between the handle connector and the hosel connector such that the decorative sheaths butt up against each other and are not directly connected to adjacent decorative sheaths when the decorative sheaths are slid over and around the shaft core.

17. The kit of claim 16, further comprising a handle.

18. The kit of claim 16, further comprising a hosel.

19. The kit of claim 16, further comprising an epoxy adhesive.

20. The kit of claim 16, further comprising a grip.

21. The kit of claim 16, further comprising a putter head.

22. The kit of claim 21, wherein the decorative sheaths include a material selected from the group consisting of epoxy, plastic, carbon fiber, hardwood, and softwood, and, wherein the shaft core includes a material selected from the group consisting of carbon fiber, steel, titanium, brass, copper, zinc, and alloys of one or more of the previous materials.

* * * * *